United States Patent [19]

Beerli et al.

[11] Patent Number: 4,974,301

[45] Date of Patent: Dec. 4, 1990

[54] METHOD AND APPARATUS FOR REGULATING THE YARN STRIP WIDTH IN WARPING MACHINES

[75] Inventors: Markus Beerli, Gossau; Manfred Bollen, Oberuzwil; Guido Bommer, Wil; Roland Schaible, Bichwil, all of Switzerland

[73] Assignee: Benninger AG, Uzwil, Switzerland

[21] Appl. No.: 354,399

[22] Filed: May 19, 1989

[30] Foreign Application Priority Data

May 27, 1988 [CH] Switzerland ..... 2036/88

[51] Int. Cl.[5] ..... D02H 13/34; B65H 54/12

[52] U.S. Cl. ..... 28/191; 28/185; 28/195

[58] Field of Search ..... 28/185, 191, 194, 195

[56] References Cited

U.S. PATENT DOCUMENTS 4,141,120 2/1979 Schenk ..... 28/191 X
4,326,322 4/1982 Gaiser ..... 28/194 X
4,549,453 10/1985 Yazaki et al. ..... 250/548 X
4,582,095 4/1986 Kronholm ..... 139/1 R
4,670,953 6/1987 Kanda et al. ..... 28/185
4,812,043 3/1984 Vanstaen ..... 356/385

FOREIGN PATENT DOCUMENTS 3527424 2/1987 Fed. Rep. of Germany .

OTHER PUBLICATIONS

Benninger Product Literature, Section Warping Machine Type SC-Perfect; No Date.

*Primary Examiner*—Werner H. Schroeder
*Assistant Examiner*—Bradley K. DeSandro
*Attorney, Agent, or Firm*—Shoemaker and Mattare Ltd.

[57] ABSTRACT

On the warping machine (12) the width (11) of the yarn strip (10) is continuously monitored by means of a line camera (25). The measured strip width is compared in a processor (32) to a stored reference value, with deviations forming a control signal for activating a control motor (35) at the warping reed (9). That ensures continuous strip width regulation, at full winding speed.

13 Claims, 2 Drawing Sheets

PRIOR ART

METHOD AND APPARATUS FOR REGULATING THE YARN STRIP WIDTH IN WARPING MACHINES

The invention relates to a method of regulating the yarn strip width in warping machines having a rotatable warping drum and a warping reed which is adjustable in respect of its width, and an apparatus for carrying out the method.

In a warping operation, in order to produce a satisfactory warp it is necessary for the individual yarn strips to be wound onto the warping drum with a high level of precision. Just minor deviations in width result in a poor winding configuration so that the warp may become useless. Various influencing factors may give rise in particular to variations in the width of the yarn strips between the warping reed and the warping drum. The following may occur for example as disturbance variables: different winding speeds, air movements caused by the rotation of the warping drum, different yarn tensions, static charging of the yarns, vibration of the installation, differences in yarn density and yarn quality, and so forth.

For the purposes of checking the strip width it was hitherto the usual practice to check the width of the individual strips by subsequently measuring same on the warping drum in order manually to readjust the warping reed as required when deviations were found. DE-A-35 27 424 discloses a measuring apparatus which makes it possible to measure the strip width while the yarn strip is running. In that arrangement, arranged parallel to the warping drum is a measuring scale and a length measuring device which co-operates therewith and which is displaceable in parallel relationship thereto. With that arrangement it is possible to locate and measure the relative position of the outermost yarns of the yarn strip. Although the measuring operation can be carried out at the maximum winding speed with that device, there is however no provision for automatic correction of the strip width.

A warping reed which can be displaced by motor means is disclosed in SA 4,670,953. In that arrangement the reed is influenced in dependence on the yarn tension, the endeavour being to produce a uniform diameter on the warping beam. The actual width of the strip after passing through the warping reed is still disregarded.

Therefore an object of the present invention is to provide a method of the kind set forth in the opening part of this specification, by means of which the strip width on the warping drum can be continuously measured and regulated in a very simple manner at full winding speed.

In accordance with the invention that object is attained by a method having the features as claimed herein.

Another object of the invention is to provide an apparatus for carrying out the method, which makes operation of the warping machine easier and which permits a more rational mode of operation.

In regard to the apparatus that object is attained by an apparatus having the features claimed herein.

Contact-less measurement of the yarn strip width by means of the optical devices has the advantage that the yarn strip is subjected to practically no physical disturbance factors, for the purposes of measuring the width thereof. The width measuring operation can also be carried out directly upstream of or at the point at which the yarn strip passes onto the warping drum so that an optimum effect is achieved with the regulation operation. Depending on the reaction capability of the regulating circuit, deviations in width of the yarn strip extend over only comparatively short distances thereon.

The width of the yarn strip may also be measured on a direction-changing roller which is disposed between the warping reed and the warping drum. In that connection the direction-changing roller may be made for example from a reflecting material, whereby the measuring process can be facilitated.

In a particularly advantageous embodiment the strip width is measured by means of a line camera. The line camera permits a high image resolution capability and thus accurate measurement results to be achieved. The camera may also be mounted in different positions in a very simple manner and can be connected to the control computer by way of optical fibres. It is also possible however to envisage using other optical measurement methods employing an incident-light or transillumination process.

Further advantages and individual features of the invention will be apparent from the following description and the drawings. An embodiment is illustrated in the drawings in which.

Figure 3A:
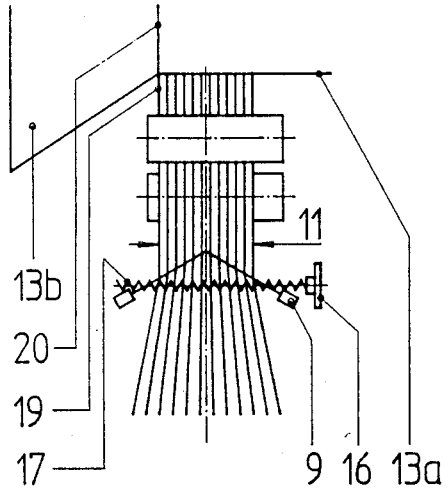
Fig 3a PRIOR ART
Figure 3B:
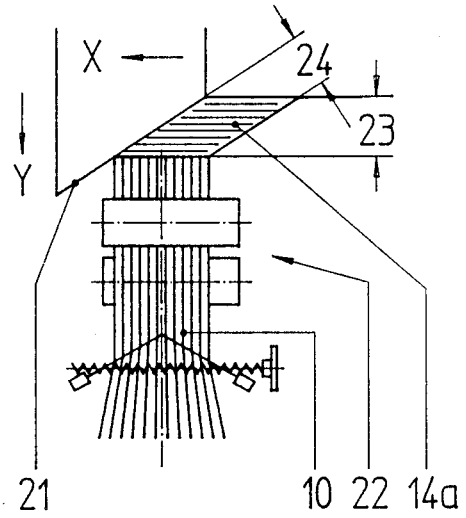
Figure 4A:
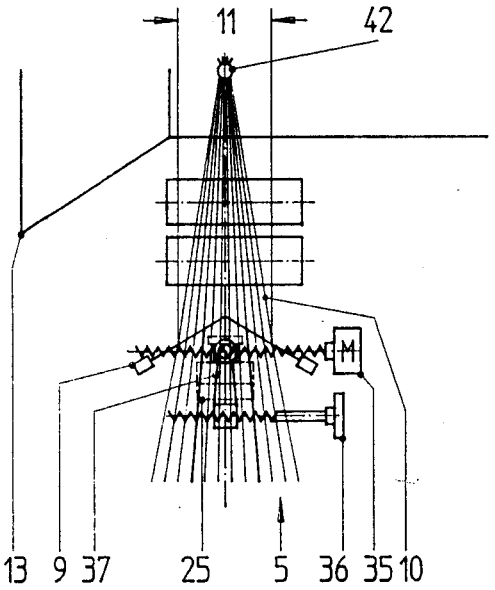
Figure 4B:
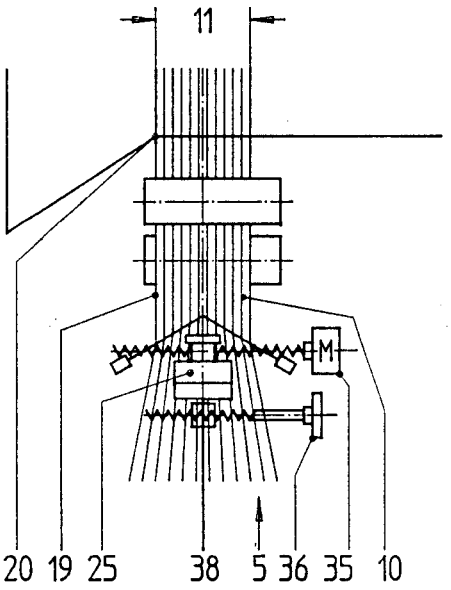

FIG. 3*a* shows the beginning of the winding operation on a warping machine in accordance with the state of the art, FIG. 3*b* shows the operation of winding the first strip on a warping machine in accordance with the state of the art, FIG. 4*a* shows preparation for the winding operation on a warping machine according to the invention, and FIG. 4*b* shows the beginning of the winding operation for the first strip on a warping machine according to the invention.

Figure 1:
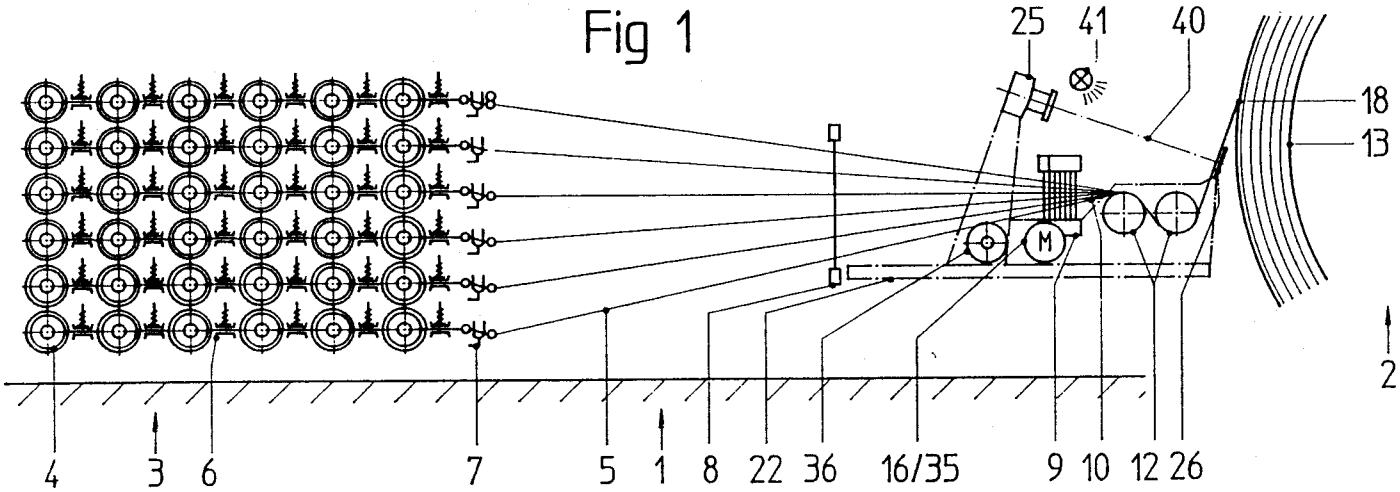
FIG. 1 is a side view of a warping installation.
Figure 2:
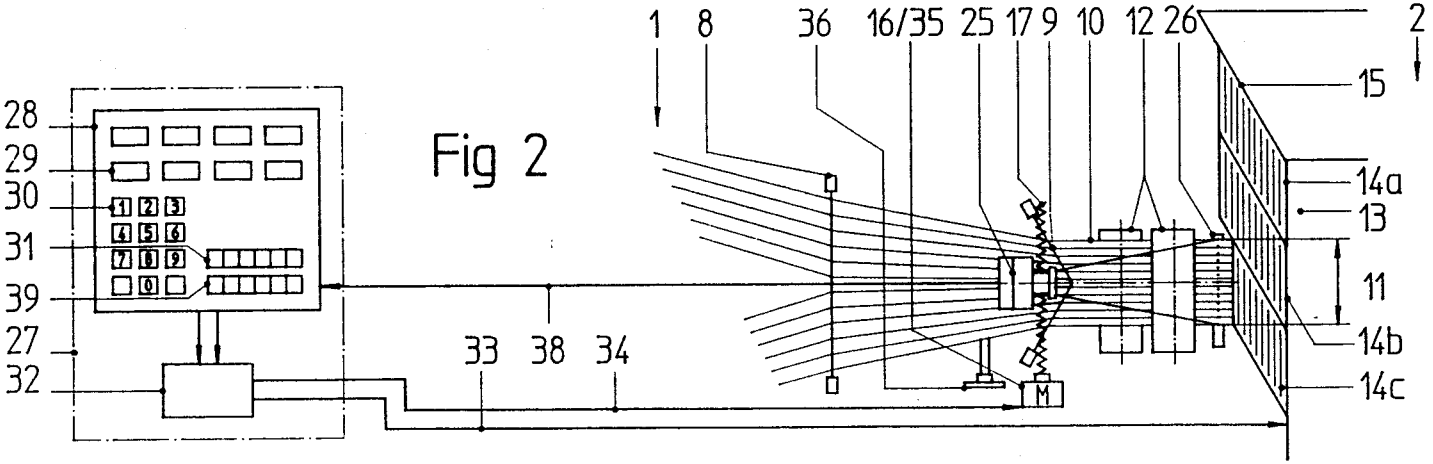
FIG. 2 is a plan view of the warping machine shown in FIG. 1.

FIGS. 1 and 2 show a conventional warping installation 1 comprising a warping machine 2 and a feed creel 3.

Fitted on the feed creel 3 are a plurality of bobbins 4, the yarns of which 5 each pass through a respective yarn tensioner 6 to produce a constant yarn tension. The yarns are monitored to ensure that they are present, at the yarn monitor 7, and then pass in the region of the warping machine 2 to the yarn cross reed 8 in which each individual yarn 5 is brought into a given sequence. In the subsequent warping reed 9, the yarns are formed in a given yarn density to form a yarn strip or ribbon which is fed to the warping drum 13, as a strip or ribbon of the desired width as indicated at 11, by way of direction-changing rollers 12.

The yarn strip 10 is wound on the warping drum in per se known manner in the form of individual strips 14*a*, 14*b*, 14*c* etc., along the cone configuration 15. In that connection it is important for the winding structure of the individual strips 14 always to remain the same so that the lengths of the yarns of all individual strips are identical. Various means (not described in detail herein) are provided to ensure that the yarn tension always remains the same for all the yarns 5, and that the yarn tension remains constant.

The desired width 11 in respect of a yarn strip 10 can be set at the warping reed 9 by means of a spindle 17. The spindle moves the two halves of the warping reed in opposite directions in per se known manner. In conventional warping machines actuation of the spindles 17 is by way of a hand wheel 16, as can be seen from FIG. 3*a*. As shown in FIGS. 1, 2 and 4 however actuation is effected by way of a control motor 35, as will be described hereinafter.

Fixed above the warping reed 9 is a line camera 25, the optical axis 40 of which is directed onto the yarn strip 10 directly upstream of the point 18 at which the yarn passes onto the warping drum 13. Arranged behind the yarn strip 10 in the measuring plane is a reflective strip 26 which can be lit by a light source 41 from the camera side. The width of the strip can thus be measured in the form of a shadow projected onto the strip 26. It would also be possible however to detect the strip width directly by way of the inherent reflection thereof, which however is only possible when dealing with reflective yarns for example of glass fibres.

The arrangement preferably uses a line camera with about 4000 pixels so that with a strip width of 400 mm, it is possible to achieve a degree of resolution of 0.1 mm. The camera 25 is mounted over the yarn strip in such a way that the optical axis 40 extends in a plane which is transverse with respect to the yarn strip and which divides the warping reed, as a bisecting line, into two halves. It will be appreciated that the line camera could also be mounted under the yarn strip, under certain conditions. It would also be possible for the optical axis not to be directed onto the yarn strip in a straight line, but by way of deflecting mirrors.

The entire assembly consisting of the warping reed, the line camera and direction-changing rollers is arranged on a warping carriage 22 for inclinedly guiding the strips 14. The warping carriage 22 may be displaced by means (not shown) both in parallel-axis relationship with the warping drum 13 and also transversely with respect to said axis. Displacement takes place automatically in the winding operation. In addition the warping reed with the line camera, for the purposes of producing parallel-axis displacement relative to the warping drum, may also be adjusted with a hand wheel 36, which is a matter of particular significance for starting the winding operation. The hand wheel 36 turns a spindle which displaces the warping reed 9 by way of a linkage 37.

FIG. 2 diagrammatically shows the operative connection of the camera 25 and the control motor 35 to an operating station 27. The station 27 comprises an input station 28 and a processor 32 which serves as a comparison means for the regulation operation. The input station 28 is provided with input keys 29, numerical push-buttons 30 and a display panel 31. It also has a calibration station 39. An input line 38 connects the camera 25 to the operating station 27, and respective output lines 33 and 34 connect the operating station 27 to the control motor 35 and to the warping machine drive (not shown in detail herein) respectively.

FIGS. 3*a* and 3*b* show a winding operation in accordance with the state of the art. In FIG. 3*a*, the operation of winding a first strip onto the winding drum is being begun. The first yarn 19 of the yarn strip 10 must lie precisely at the point of intersection 20 of the cylindrical portion 13*a* with respect to the cone 13*b* of the warping drum 13.

As soon as that position has been set, the operation of winding the first strip 14*a* can be begun, as shown in FIG. 3*b*. A requirement in that arrangement for correct winding structure is that the yarn strip 10 is deposited precisely along the cone line 21. For that purpose, as already mentioned, the warping carriage 22 is displaced in the X- and in the Y-direction so as to provide a winding structure 24 which is parallel to the cone 13*b*. If any deviations in width are detected, the warping reed 9 is displaced manually by way of the handwheel 16.

The warping process with the apparatus according to the invention takes place in the following manner: firstly, as shown in FIG. 4*a*, the yarns 5 of the yarn strip 10 are passed through the warping reed 9 and provided with a knot 42 which is attached to the warping drum 13. The line camera 25 is only indicated in FIG. 4*a*.

Before the winding operation can begin, the warping data must be inputted at the operating station 27. The input data can be read off directly in the display panel 31. From the warping data the processor determines the strip width 11 required, which is automatically set at the warping reed 9 by way of the output line 34 and the control motor 35. At the same time the processor 32 stores that strip width as a reference value to which the measured actual value is subsequently permanently compared. By way of the output line 33 however the processor 32 also controls the warping machine, in particular the speed of rotation of the warping drum or the starting and stopping thereof and also at the same time the displacement of the warping carriage 22.

Then, as shown in FIG. 4*b*, the warping reed is moved into the basic position for winding the first strip, after one or two revolutions of the warping drum, using the handwheel 36 which is operative by way of the linkage 37. For that purpose the first yarn must again be brought precisely to the point of intersection between the cylindrical portion and the cone of the warping drum.

When the preparatory operations as described above have been concluded, the warping process can begin. The warping drum 13 rotates at the desired speed and the yarns 5 are drawn from the feed creel 3. The camera 25 continuously measures the width 11 of the yarn strip 10 and feeds the processor with the values ascertained in that way, by way of the input line 38. In the processor the detected values are compared to the stored reference value, deviations forming a control signal which is supplied to the control motor 35 by way of the output line 34. The control motor varies the width of the warping reed 9 towards the reference value until the measured actual value again corresponds to the reference value.

If due to a disturbance factor which can no longer be corrected, the difference between the reference value and the actual value increases more and more, the processor 32 can be programmed in such a way that an alarm signal is triggered off and/or the warping machine is stopped.

The above-described regulating circuit eliminates disturbance factors in the winding operation so that it is possible to carry out the winding operation continuously with a practically constant strip width. Permanent regulation of the width of the yarn strip also has the advantage that the corrections to be made at the warping reed are not falsified by virtue of the installation being stationary. In addition the operator is relieved of the burden of carrying out the fastidious measuring and adjusting operations, so that human sources of error are also extensively eliminated.

Instead of the input of a reference value prior to the beginning of the winding operation, the installation can also be controlled in such a way that firstly, during a given measuring period, for example when winding a first strip 14*a*, all the measurement values detected by the camera 25 are put into store. An average value is calculated therefrom, to serve as a reference value for the regulating operation when the subsequent strips are being wound. It would also be possible for the installation to be operated semi-automatically, in which case the warping reed 9 is not automatically re-adjusted. In the event of excessive deviations from a calculated average value or from a predetermined reference value, instead of the control motor 35 being activated, the arrangement only provides for triggering off an alarm signal or stopping the machine.

It will be appreciated that, instead of the line camera 25, it would also be possible to use another optical measurement means for the contact-less measurement operation. Thus for example it would be possible to use a light source which projects a beam of light, for example a laser beam, onto a position-sensitive photoelectric detector. Apparatuses for optical measurement value detection are already sufficiently known to the man skilled in the art and are therefore not described in greater detail herein.

We claim:

1. Apparatus for maintaining a desired yarn strip width in warping machines (2) comprising a rotatable warping drum (13) and a warping reed (9) which is adjustable in respect of its width, said warping reed being arranged on a warping carriage which is displaceable both in parallel-axis relationship with the warping drum and transversely with respect to said axis during the winding operation so as to build up individual yarn strips onto the warping drum (13) for adjusting the width of the warping reed for measuring the width of the yarn strip (10) in a measurement plane between the warping reed (9) and the warping drum (13), and a comparison means (32) co-operating with a control motor (35) and a measuring means (25) for comparison of the measured strip width with a stored reference value.

2. Apparatus as set forth in claim 1 characterised in that the measuring means (25) and the warping reed with the control motor are displaceable in axis-parallel relationship with respect to the warping drum relative to the warping carriage (22) or the warping drum (13) respectively.

3. Apparatus as set forth in claim 1 characterised in that the measuring means is a line camera (25) which is directed onto the yarn strip (10).

4. Apparatus as set forth in claim 3 characterised in that for the purposes of forming the measurement plane, a reflective strip (26) is arranged close to the warping drum (13) on the side of the yarn strip (10) which is remote from the line camera (25), wherein the reflective strip (26) can be lit with a light source arranged on the camera side, to form a shadow.

5. Apparatus as set forth in claim 4 characterised in that the line camera (25) is arranged over the yarn strip (10).

6. Apparatus as set forth in claim 5 characterized in that the optical axis of the line camera (25) is in a plane which is transverse with respect to the yarn strip (10) and which at the same time passes through the middle of the warping reed (9).

7. A method of maintaining a desired yarn strip width in warping machines (2) comprising a rotatable warping drum (13) and a warping reed (9) which is adjustable in respect of its width, said warping reed being arranged on a warping carriage which is displaced both in parallel-axis relationship with the warping drum and transversely with respect to said axis during the winding operation so as to build up individual yarn strips on the warping drum, and further comprising in the winding operation, after leaving the warping reed (9), measuring the width of the yarn strip (10) in a contact-less mode using optical means (25) at the point of which it passes onto the warping drum, detecting an actual value and comparing the same with a reference value in a comparison means (32) and in the event of deviations from the reference value activating a control motor (35) at the warping reed (9) and thereby adjusting the width of the warping reed towards the reference value.

8. A method in claim 7 characterised in that the warping drum (13) is stopped when a predeterminable difference between the reference value and the actual value is exceeded.

9. A method as set forth in claim 7 characterised in that the width of the yarn strip is measured by means of a line camera (25) directed onto the yarn strip.

10. A method in claim 9 and 23, characterised in that the warping drum (13) is stopped when a predeterminable difference between the reference value and the actual value is exceeded.

11. A method of maintaining a desired yarn strip width in warping machines (2) comprising a rotatable warping drum (13) and a warping reed (9) which is adjustable in respect of its width, said warping reed being arranged on a warping carriage which is displaced both in parallel-axis relationship with the warping drum and transversely with respect to said axis during the winding operation so as to build up individual yarn strips onto the warping drum, and further comprising in the winding operation, after leaving the warping reed (9), detecting and measuring width of the yarn strip (10) is in a contact-less mode using optical means (25), at the point at which it passes onto the warping drum, forming an average value in a computer from the measurement values detected during a given measurement period, and in the winding operation, after expiry of the measurement period, the average value serves as a reference value which is continuously compared in a comparison means to the actual value which is just being measured, and activating a control motor at the warping reed and thereby adjusting the width of the warping reed toward the reference in the event of deviations from the reference value.

12. A method as set forth in claim 11 characterised in that the width of the yarn strip is measured by means of a line camera (25) directed onto the yarn strip.

13. A method in claim 11 characterised in that the warping drum (13) is stopped when a predeterminable difference between the reference value and the actual value is exceeded.

* * * * *